United States Patent [19]

Franchi

[11] Patent Number: 4,535,903

[45] Date of Patent: Aug. 20, 1985

[54] CHILD PROOF MEDICINE VIAL

[76] Inventor: Roberto D. Franchi, 167 Pequot Tr., Stonington, Conn. 06378

[21] Appl. No.: 604,663

[22] Filed: Apr. 27, 1984

[51] Int. Cl.[3] ..... B65D 55/02

[52] U.S. Cl. ..... 215/213; 215/211; 215/296; 215/299; 206/807; 206/534; 220/284

[58] Field of Search ..... 215/211, 213, 224, 296, 215/299, 306; 220/315, 306, 307, 284; 206/540, 459, 807, 534

[56] References Cited

U.S. PATENT DOCUMENTS

| | | | |
|---|---|---|---|
| 4,146,146 | 3/1979 | Mar | 215/213 |
| 4,358,022 | 11/1982 | Geiger | 215/224 |
| 4,458,819 | 7/1984 | Geiger | 215/224 |
| 4,462,501 | 7/1984 | Franchi | 215/296 |

*Primary Examiner*—George T. Hall

*Attorney, Agent, or Firm*—Sughrue, Mion, Zinn, Macpeak & Seas

[57] ABSTRACT

A child proof medicine vial is provided having a bead for mating in a recess in a flange in the cap whereby the cap is tightly secured to the vial. The cap is provided with a recess and complimentary slots and inner chamber whereby a panel may be slidable into and out of the cap. When the panel is fully inserted in the cap, there are no projections on the cap for facilitating removal of the cap from the vial. When fully retracted from the cap, the panel permits the user to raise the cap thus permitting access to the vial. When fully retracted, the panel may have indicia to the effect that the vial is nonchild proof. An integral hinge is provided between the cap and vial so that the cap may be flipped away from, yet attached to, the vial.

7 Claims, 16 Drawing Figures

CHILD PROOF MEDICINE VIAL

BACKGROUND OF THE INVENTION

1. Field of the Invention

This invention pertains to medicine vials or containers of the type having child proof or safety closure means.

2. Statement of the Prior Art

The prior art shows safety locks or latches for caps of various types for containers and medicine vials. These prior art devices utilize either pins or sliding bars or pivoting latching mechanisms to secure the cap to the container. Unlike the prior art, the present invention does not use pins or sliding bars or latching mechanisms to secure the cap to the container or vial. Rather, the cap is secured to the vial by bead and recess means. To facilitate removal of the cap from the vial, a slidable panel is retracted from the cap thus facilitating raising of the cap from the vial. Representative of the prior art are the following list of patents.

| Patentee | U.S. Pat. No. | Issue Date |
|---|---|---|
| Yung et al | 3,860,135 | Jan. 14, 1975 |
| Fields | 3,923,180 | Dec. 2, 1975 |
| Lemons | 3,924,768 | Dec. 9, 1975 |
| Vere | 4,127,221 | Nov. 28, 1978 |
| Mar | 4,146,146 | Mar. 27, 1979 |

SUMMARY OF THE INVENTION

This invention provides a safety cap for medicine vials or other containers which is simple to manufacture and easy to install.

Another object of this invention is to provide a medicine vial and safety cap wherein the cap is snap fitted by a bead and ridge arrangement onto the vial.

It is yet another object of this invention to provide a vial and safety cap therefor, the cap having edges contiguous with the vial walls whereby no projections are available to aid in removing the cap from the vial.

Yet another object of this invention is to provide a vial and cap therefor, the cap having a recess therein for reception of a slidable panel.

Still another object of this invention is to provide a vial and cap arrangement wherein the cap has a recess and opposing slots for receiving the slidable panel which has opposing flanges for insertion into the slots.

And yet another feature of this invention is to provide a vial and cap arrangement wherein a slidable panel is removable from a recess in the cap to aid in removing the cap from the vial.

And still another object of this invention is to provide an integral living hinge between the cap and vial so that the cap may be flipped away from the vial yet remain attached thereto.

These and other objects of this invention will become apparent to those skilled in the art to which it pertains from a reading of the specification when taken in light of the annexed drawings.

DESCRIPTION OF THE PREFERRED EMBODIMENT

Figure 1:
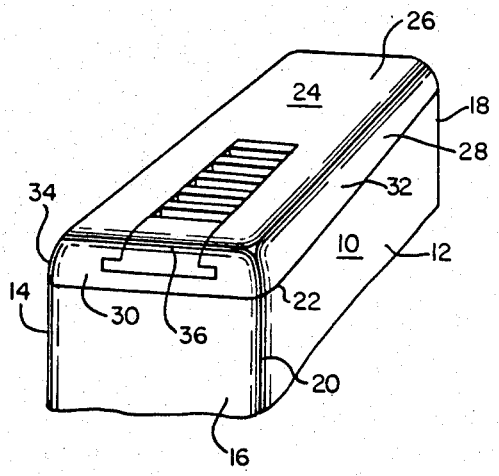
FIG. 1 is a partial prespective view of a medicine container or vial and cap arrangement, the cap having a slidable panel therein.
Figure 2:
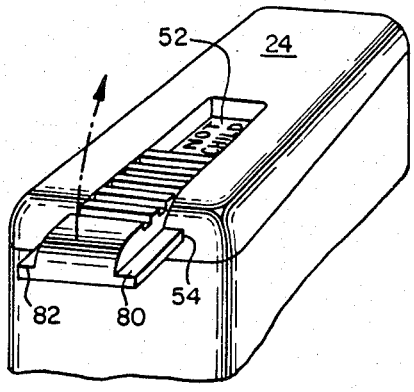
FIG. 2 is a view similar to FIG. 1, the slidable panel is shown extended or retracted out of the cap.

Referring in more detail to the drawings, FIG. 1 shows a medicine container or vial 10 having side walls 12, 14 and end walls 16, 18. Edges or corners 20 of the container or vial are rounded and terminate in a top flat edge 22. A cap 24 for the vial 10 has a top surface 26, side walls 28 (one shown) and end wall 30 (one shown).

The cap 24 has generally rounded edges 32, 34 with the edges 32 coincident with the rounded edges or corners 20 of the container. A slidable panel 36 is shown fully inserted in a recess and slots and inner chamber in the cap. These features to be more fully described below. With the slidable panel fully inserted in the recesses, slots and inner chamber in the cap, it can readily seen that there are no projections or extending edges on the cap to permit gripping of the cap for removal of same from the vial.

Figure 3:
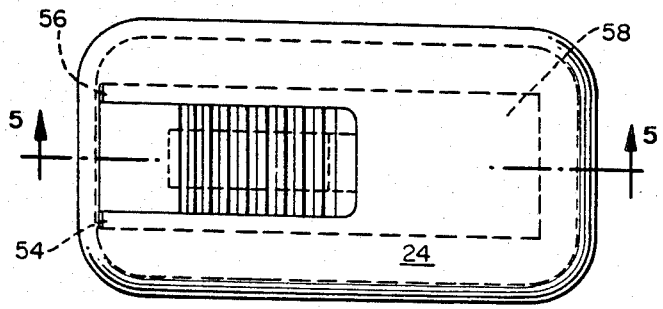
FIG. 3 is a plan view of the cap showing the panel fully inserted in the cap.
Figure 4:
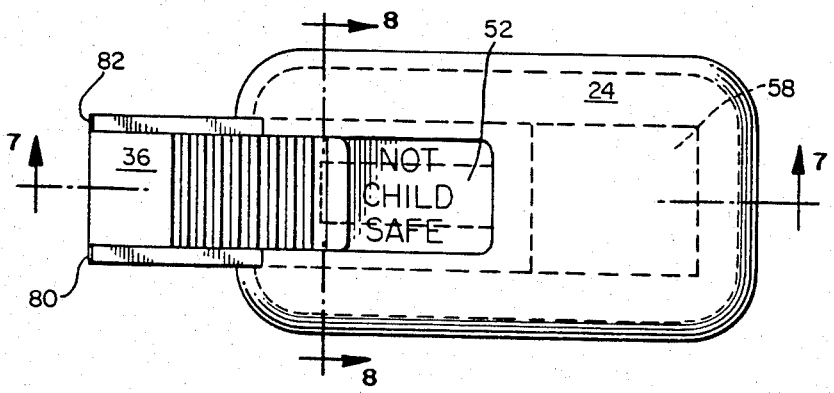
FIG. 4 is a plan view of the cap showing the panel fully retracted or extended out of the cap.
Figure 5:
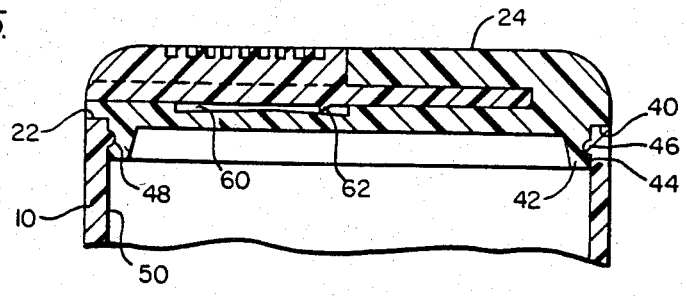
FIG. 5 is a cutaway side view of the container or vial and cap arrangement showing the cap attachment means and the slidable panel fully inserted in the cap.
Figure 7:
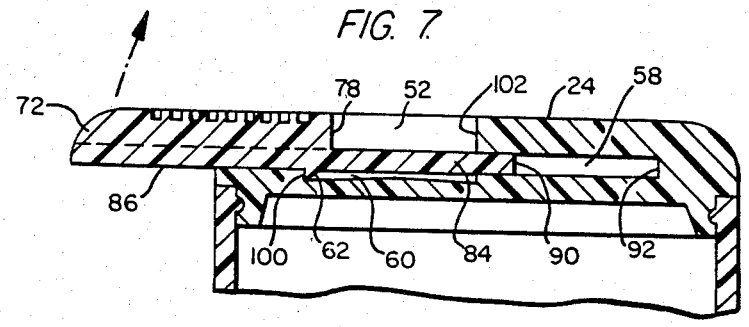
FIG. 7 is a view similar to FIG. 5 except showing the slidable panel fully retracted from the cap.
Figure 8:
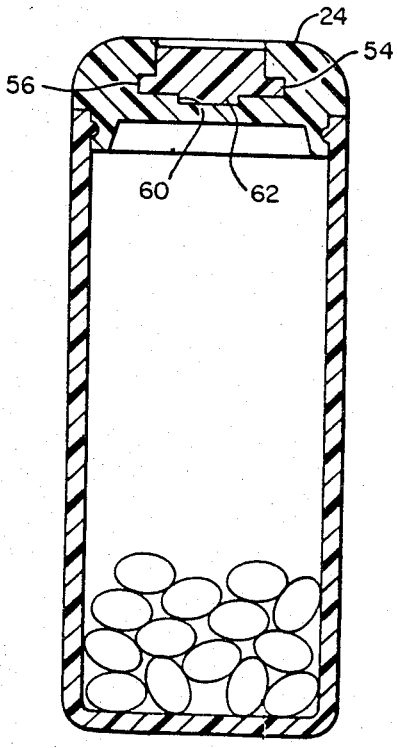
FIG. 8 is a sectional end view of the container and cap arrangement showing the slidable panel in grooves or slots in the cap.

Referring to FIGS. 5, 7 and 8, it can be seen that the cap 24 has a peripherally extending flat surface 40, downwardly extending flange 42 having an outer face 44 with a groove 46 extending about the periphery of the face 44. As can be seen, the groove 46 snaps onto bead 49 which extends peripherally about the inside wall 50 of the vial 10, a distance just below the top flat edge 22. By this construction, the cap 24 is tightly held to the vial 10. Again, note in FIG. 5 that there are no projecting edges from the cap 24 to permit gripping of the cap for removal of same from the vial. Thus, a child or other person of diminished responsibility could not raise the cap from the vial permitting access to medicine therein. FIGS. 1, 3 and 5.

Figure 6:
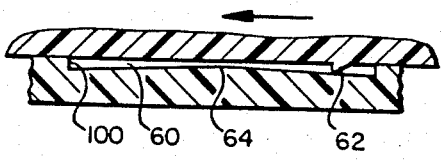
FIG. 6 is a sectional view of the cap and slidable panel and shows a depending tab or stop in a recess in the cap.
Figure 9:
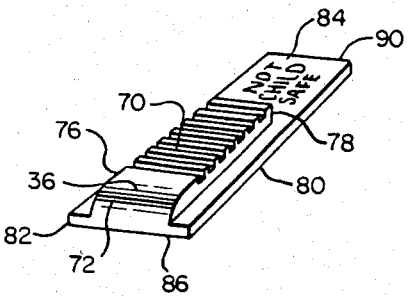
FIG. 9 is a perspective view of the slidable panel showing flanges on the sides thereof and serrations on the top surface.

Referring to FIGS. 2, 3, 4, 7 and 8, the cap 24 has a recess 52 including side guideway slots 54, 56, inner chamber 58 and depressed keyway 60. The slidable panel 36, FIG. 9, is shown to have a top serrated surface 70, curved front wall 72, side walls 74, 76, end wall 78, side flanges 80, 82 and rear tab 84. The undersurface 86, FIG. 7, is generally flat except for a depending resistance tab and stop member 62 which extends into and is as wide as the depressed keyway 60. The keyway 60, FIG. 6, may be arcuate in nature with the apex at 64 or it may slant upwardly in the direction of the arrow. This construction permits increasing resistance to forward or outward movement of the panel 36 by reason of the resistance exerted on the depending tab 62. Thus, it requires considerable pressure in the direction of the arrow to move the panel 36 outwardly of the cap 24.

Referring to FIGS. 2, 3, 4 and 7, the flanges 80, 82 of the panel 36 are inserted into slots 54, 56 of the cap 24. The panel 36 is then pushed rearwardly with the rear tab 84 extending into the inner chamber 58. The panel stops when the wall 90 of the tab 84 strikes wall 92 within the innermost end of the chamber 58. When fully inserted, the rounded face 72 of the panel 36 is complimentary or flush with the top surface 26 and edge 30 of the cap 24 whereby there are no projections on the cap to permit raising of the cap from the vial.

When the panel is fully retracted from the cap, rear tab 84 is exposed in the recess 52 and may carry indicia such as "not child resistant." Forward movement of the panel 36 is checked when the tab 62 abuts against vertical wall 100 of the keyway 60. When the panel 36 is fully inserted in the cap, wall 78, FIG. 7, abuts wall 102 whereby the recess 52 is closed and thus no indicia is exposed on the slidable panel 36.

Figure 10:
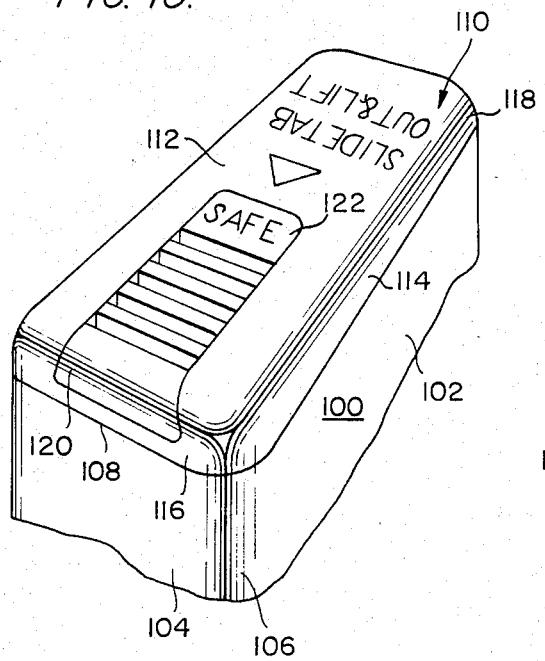
FIG. 10 is a perspective view of a modified form of the cap showing the slidable panel fully inward and having a stop boss with indicia thereon.
Figure 11:
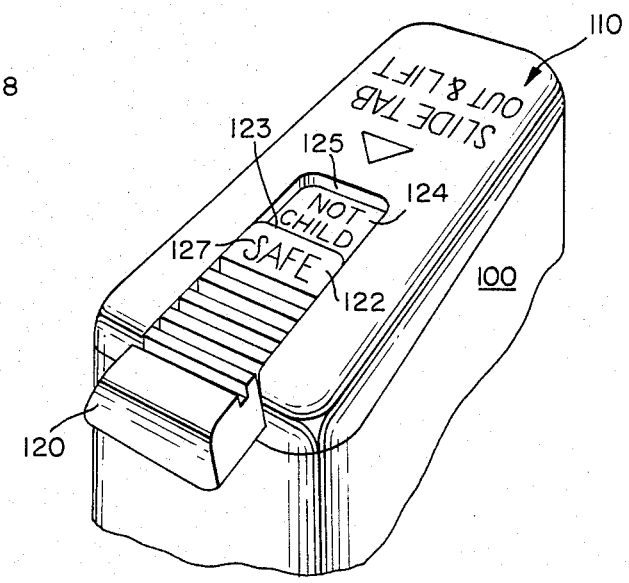
FIG. 11 is a perspective view of the cap of FIG. 10. The panel is slightly retracted and shows the stop boss with indicia thereon and a lower wall with additional indicia.

A modified form of the preferred embodiment of the invention is shown in FIGS. 10 through 16. Referring to FIG. 10, a container 100 is shown as having side walls 102 (one shown) and end walls 104 (one shown). The container 100 has rounded corners 106 and a top flat edge 108. A cap 110 for the container has a top surface 112, side walls 114 (one shown) and end walls 116 (one shown). The cap 110 has rounded edges 118 which coincide with the rounded edges 106 of the container. A slidable panel 120 is shown fully inserted in a recess and inner chamber in the cap. The panel 120 has a raised boss 122 which is flush with the top surface 112 of the cap. The boss 122 has a rear vertical wall 123 which, when the panel 120 is fully inward, abuts against the vertical surface 125. The boss 122 thus functions as a stop for the panel 120 as well as a surface for the "safe" indicia 127. FIG. 11 shows the panel 120 slightly retracted to expose a lower surface 124 behind the upstanding boss 122. The lower surface 124 bears "not child" indicia thereon. It can be readily seen that the vial is "child-safe" when the panel is fully inserted in the recess and inner chamber. The vial is "not child safe" when the panel 120 is slightly retracted from the cap whereby the panel functions as a lever to raise the cap from the vial.

Figure 12:
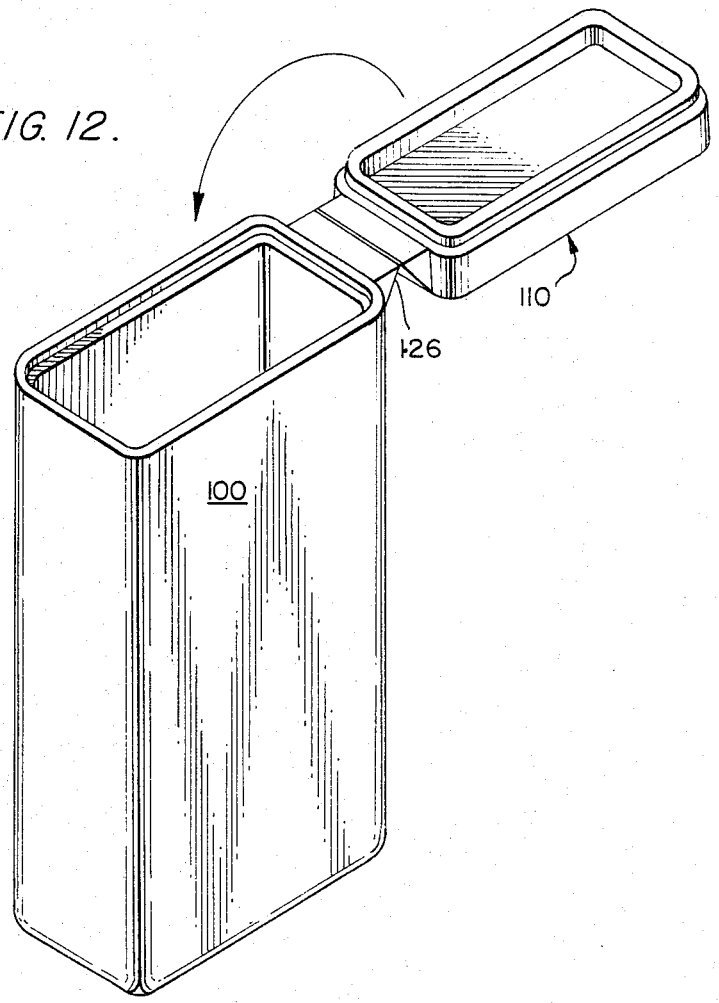
FIG. 12 is a perspective view of the vial and cap and shows a hinge between the vial and cap.

FIG. 12 shows the container 120 and the cap 110 having an integral hinge 126 whereby the cap remains attached to the container 130 when the cap is removed.

Figure 13:
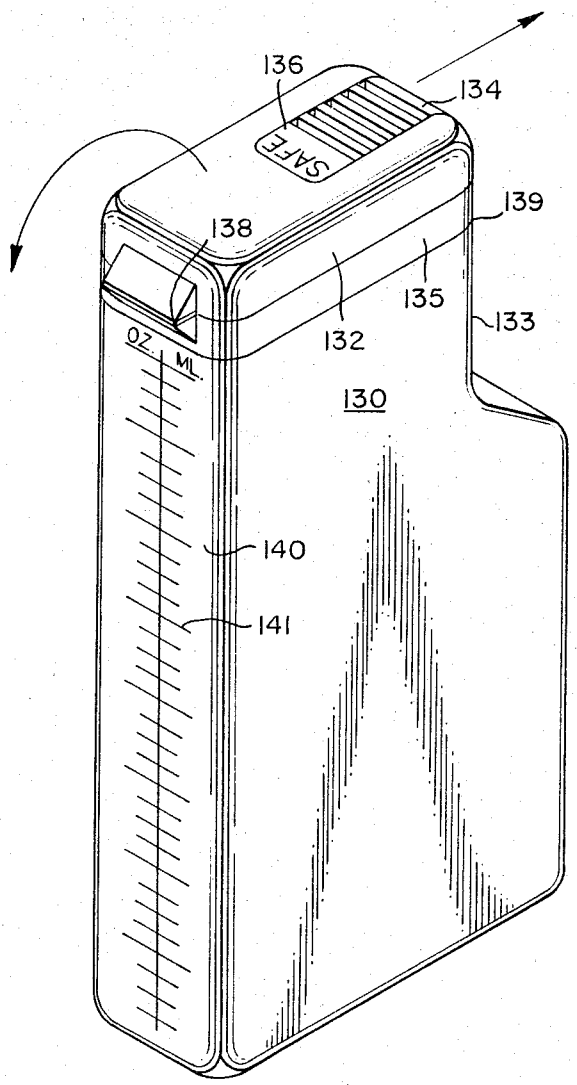
FIG. 13 is another modification of the invention and shows a container with a cap hingedly attached thereto.

FIGS. 13 through 16 show yet another embodiment of the invention. Referring to FIG. 13, the container 130 is generally rectangular except for the indent 133. The cap 132 has the slidable panel 134 with a raised stop boss 136 thereon. The cap 132 is formed in two sections, one is the cap proper 132 and the other is a lower section 135. The sections 132 and 135 are molded together and are connected to each other by an integral hinge 138. The lower section 135 is heat sealed to the top edge 139 of the container 130. The end wall 140 has indicia 141 for indicating the amount of liquid in the container.

Figure 15:
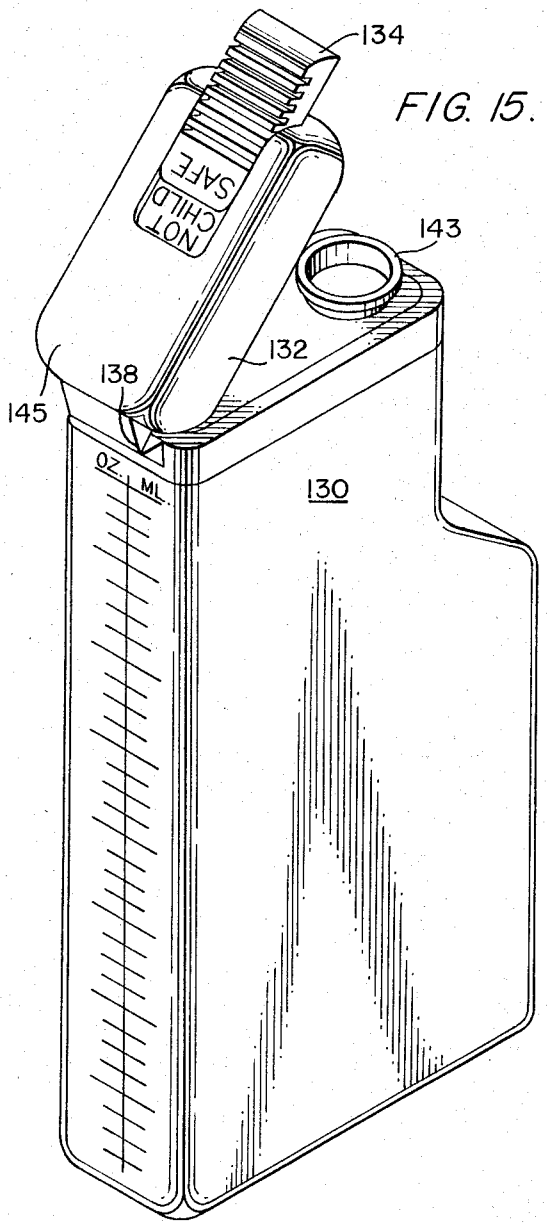
FIG. 15 is another perspective view of the container and cap, the cap is raised on a hinge.
Figure 14:
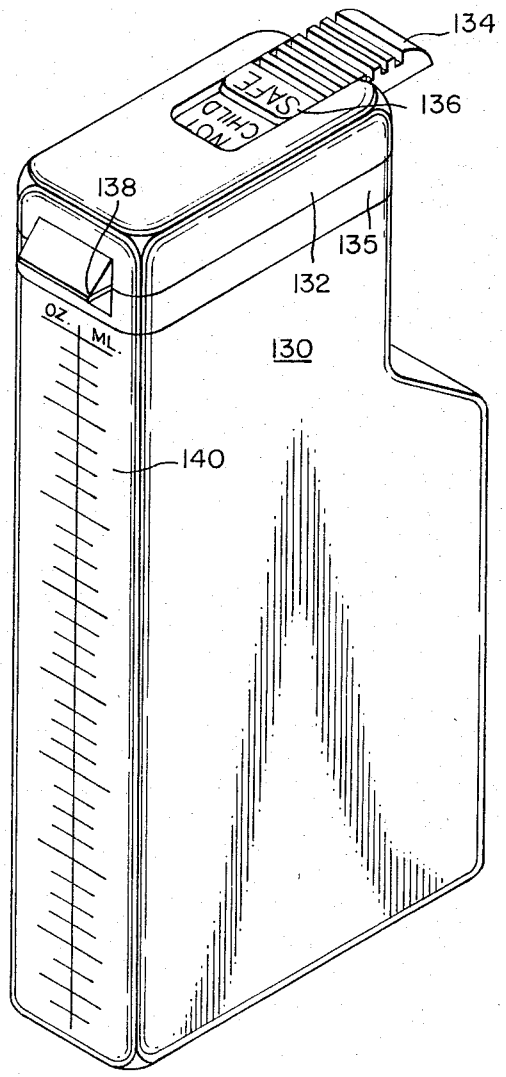
FIG. 14 is a perspective view of the container and cap of FIG. 13 and shows the slidable panel slightly retracted.
Figure 16:
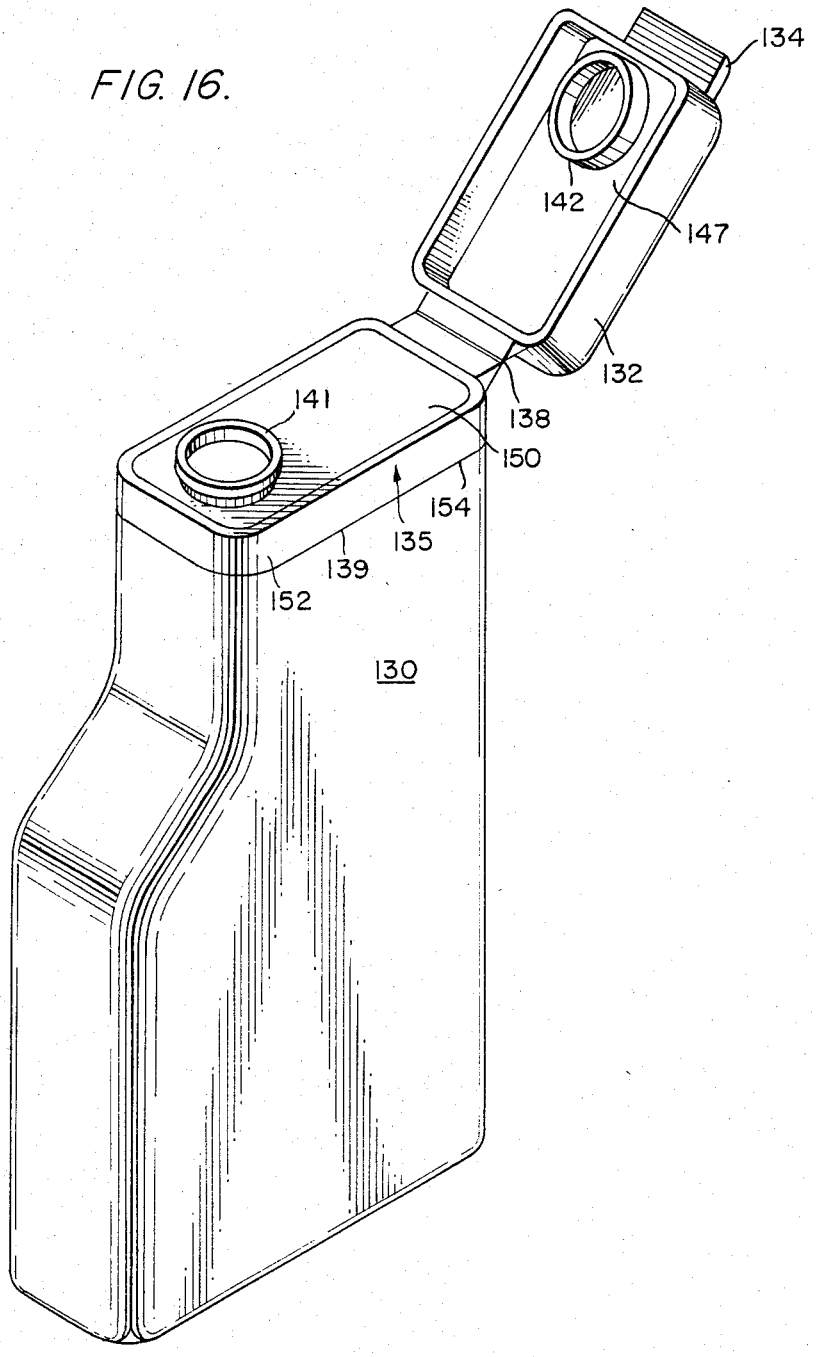
FIG. 16 shows the cap flipped away from the container yet it remains thereto by the connection of the hinge.

FIG. 14 is the same as FIG. 13 except the panel 134 is retracted so as to be used as a lever to raise the cap. FIG. 15 shows the cap 132 in a raised position to expose a pouring spout 143. FIG. 16 is a reverse of FIG. 15 and shows the cap 132 flipped away from the container 130 on the hinge 138.

Referring again to FIG. 15, the cap 132 has an upper surface 145 in which there is a recess for receiving the panel 134. The lower surface 147, FIG. 16, has a spout sealing member 142 in the form of a ring which telescopes over the spout 141. The lower section 135 comprises a flat surface 150 having the spout 141 and a depending flange 152 having an edge 154 which is heat sealed to the edge 139 of the container.

By this construction, there is provided a child safe medicine vial which requires no mechanical hooks, pins, bars or latches to prevent removal of the cap.

While the invention has been shown and described in detail with reference to a preferred embodiment thereof, it will be understood to those skilled in the art to which this invention pertains that various changes in form and detail may be made therein without departing from the spirit and scope of the invention.

What I claim is:

1. A medicine container comprising:
side walls and end walls having rounded corners;
a bead extending circumferentially of the inside of said walls near the open end thereof;
a cap having a top surface interrupted by a recess having a vertical surface therein and having a depending flange with a groove therein for mating with said bead;
an integral hinge between the container and the cap; and
a slidable panel in the recess in the cap, said panel having a raised boss with a rear vertical wall which abuts said vertical surface thus checking inward movement of the slidable panel.

2. A medicine container as defined in claim 1, wherein:
said raised boss having a surface flush with the surface of said cap.

3. A medicine container as defined in claim 1, wherein:
said slidable panel having a raised boss bearing "safe" indicia and further having a lower surface behind said raised boss which surface bears "not child" indicia.

4. A medicine container as defined in claim 1, wherein:
said cap comprising an upper section and a lower section hingedly connected together.

5. A medicine container as defined in claim 4, wherein:
said lower section comprising a planar surface having a pouring spout and a depending flange heat sealed to a top edge of the container.

6. A medicine container as defined in claim 4, wherein:
said upper section having a slidable panel in an upper side and a spout sealing means in a lower side.

7. A medicine container as defined in claim 1, and:
said container having indicia on an end wall to indicate the quantity of medicine in the container.

* * * * *